US012258749B2

(12) United States Patent
Barenski, Jr. et al.

(10) Patent No.: US 12,258,749 B2
(45) Date of Patent: Mar. 25, 2025

(54) HEIGHT ADJUSTABLE HANGER WITH COMPRESSION MEMBER

(71) Applicant: OMG, Inc., Agawam, MA (US)

(72) Inventors: Peter Barenski, Jr., Stockbridge, MA (US); Logan Carlson, Wilbraham, MA (US); Timothy F. Gillis, Florence, MA (US); Arun Srinivasan Venkatesan, Feeding Hills, MA (US); Frederick A. Enko, Westfield, MA (US)

(73) Assignee: OMG Building Products LLC, Agawam, MA (US)

( * ) Notice: Subject to any disclaimer, the term of this patent is extended or adjusted under 35 U.S.C. 154(b) by 109 days.

(21) Appl. No.: 18/007,617

(22) PCT Filed: Jun. 3, 2021

(86) PCT No.: PCT/US2021/035606

§ 371 (c)(1),
(2) Date: Dec. 1, 2022

(87) PCT Pub. No.: WO2021/247803

PCT Pub. Date: Dec. 9, 2021

(65) Prior Publication Data

US 2023/0235549 A1 Jul. 27, 2023

Related U.S. Application Data

(60) Provisional application No. 63/033,868, filed on Jun. 3, 2020.

(51) Int. Cl.
*E04B 1/26* (2006.01)

(52) U.S. Cl.
CPC .... *E04B 1/2612* (2013.01); *E04B 2001/2644* (2013.01)

(58) Field of Classification Search
CPC ..... E04B 1/2612; E04B 2001/2644; E04B 1/388; E04B 1/003; E04B 5/12; E04B 5/14

(Continued)

(56) References Cited

U.S. PATENT DOCUMENTS 783,807 A 2/1905 Tuteur
4,223,866 A 9/1980 Black (Continued)

FOREIGN PATENT DOCUMENTS

WO 2017095798 A1 6/2017

OTHER PUBLICATIONS

"How to Install a Joist Hanger," finehomebuilding, video, Dec. 20, 2018, retrieved from <https://www.youtube.com/watch?v=1hv27hrOz0g>.

(Continued)

*Primary Examiner* — Paola Agudelo
(74) *Attorney, Agent, or Firm* — Alix, Yale & Ristas, LLP

(57) ABSTRACT

A hanger for attaching a structural beam to a building substructure has a first panel spaced from a second panel with a web extending therebetween. The web includes a bias member or compression member for biasing a beam upward. The web may include an opening through the bias member for receipt of a fastener driven from underneath the web into a beam received by the web, whereby driving of the fastener into the beam pulls the beam downward against the bias of the compression member. Additional versions exist with different leveraging surfaces to assist the fastener in pulling the beam downward. The hanger may also include one or more openings in the side panels, each opening associating with an opening in a rear panel to receive a fastener driven (Continued)

obliquely through a side panel opening into a beam and a building support member to attach the beam.

25 Claims, 10 Drawing Sheets

(58) Field of Classification Search
USPC ..... 52/126.1; 403/230
See application file for complete search history.

(56) References Cited

U.S. PATENT DOCUMENTS 4,480,941 A * 11/1984 Gilb ..... E04B 1/2612 248/216.1
5,104,252 A * 4/1992 Colonias ..... E04B 5/14 403/230
6,523,321 B1 * 2/2003 Leek ..... E04B 1/2612 52/289
9,206,594 B1 * 12/2015 Grevious ..... F16B 7/0486
9,394,680 B2 * 7/2016 Bundy ..... E04B 1/2612
10,179,992 B2 * 1/2019 Brekke ..... E04B 1/2612
10,370,842 B2 * 8/2019 Wesney ..... E04B 1/2612
11,193,268 B2 * 12/2021 Sasanecki ..... E04B 1/2612
2005/0069380 A1 * 3/2005 Shelton ..... E04G 23/0218 403/230
2008/0172976 A1 * 7/2008 Carney ..... E04B 5/12 52/702
2009/0113839 A1 * 5/2009 Carr ..... E04B 1/2612 52/712

OTHER PUBLICATIONS

International Search Report and Written Opinion mailed Oct. 13, 2021 for International Patent Application No. PCT/US2021/035606.

* cited by examiner

HEIGHT ADJUSTABLE HANGER WITH COMPRESSION MEMBER

CROSS-REFERENCE TO RELATED APPLICATION

This application claims priority to 63/033,868 for "Height Adjustable Joist Hanger with Compression Member", filed Jun. 3, 2020, the entire contents of which are incorporated herein by reference.

BACKGROUND

This disclosure relates generally to the field of building construction hangers, more particularly to a hanger for supporting an elongate beam, such as a joist, relative to a building support member (i.e., ledger), and more particularly a joist that provides an upward bias on the beam to allow vertical adjustment.

In construction and building fields, hangers are common for assisting in the connection of one building member to another, such as an elongate beam to a rear support member, such as a ledger. Hangers are often formed of a strong metal like steel and include numerous sides and surfaces used for attaching to a support member and beam, and holding and supporting the beam.

One common type of beam contemplated for use with the disclosed hanger is a deck or floor joist used as a substructure to support an overlying deck or floor structure. Deck joists can attach to an end support member, usually a ledger on a side of a building, and extend substantially perpendicular therefrom at a desired height, with all of the joists substantially parallel and at the same height as the other joists. A hanger is used as an intermediate member to attach the joists to the support member.

A common problem associated with decking materials is that lumber is not always sized completely accurately and consistent. The height of joists can thus vary from one another by as much as 0.5 inches simply due to common production deviations or shrinkage of the wooden materials due to drying. This phenomenon can cause inconsistencies and integrity issues with building structures.

Thus, it would be useful to provide a hanger with capabilities to adjust the height of a beam (joist) that it supports and attaches to a building support member.

SUMMARY

Among the benefits and improvements disclosed herein, other objects and advantages of the disclosed embodiments will become apparent from the following wherein like numerals represent like parts throughout the several figures. Detailed embodiments of height adjustable hanger with compression member for use in securing beams to building support members are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a hanger for attaching a joist to a rear ledger. However, it is understood that the embodiments are not limited as such, and the inventive concepts present in the disclosed embodiments apply to a wide variety of hangers or brackets for use in attaching elongate building support members or beams to another support member. Herein, the term "joist" is synonymous with and shall encompass a beam or elongate building member. Likewise, the term "ledger" is synonymous with and shall encompass any building support member or structure to which a beam may be attached.

In one embodiment, a hanger for supporting an elongate building member, comprises a first side extending from a top to a bottom and a second side extending from a top to a bottom and spaced laterally from the first side. A web extends between and is connected to the first side and the second side proximate the respective bottoms the web comprises a compression member configured for providing a bias force in a direction toward the tops.

In another embodiment, a building support connection comprises a building support member, an elongate beam member and a hanger. The member extends substantially perpendicular to the building support member. The hanger comprises a first side extending from a top to a bottom and a second side spaced laterally from the first side and extending from a top to a bottom. A web with an integral compression member extends between the first side and second side proximate the respective bottoms. The hanger is fixed to the building support with the web extending outward and the elongate beam member is received between the first side and second side while supported by the web. When the beam is received between the first side and second side, the compression member biases the beam member toward the top ends.

A hanger for supporting an elongate building member comprises a substantially flat first side panel extending from a top to a bottom and a substantially flat second side panel extending from a top to a bottom substantially parallel to the first side panel and spaced laterally therefrom. A web with a bottom panel extends between and substantially perpendicular to the first side panel and the second side panel at the respective bottoms. An upwardly extending compression member extends from the bottom panel into a spacing between the first side panel and second side panel and provides an upward bias force on a beam positioned between the first side panel and second side panel with a lower edge supported by the web.

The embodiments provide a robust hanger for connecting a beam to a ledger that allows an installer to vertically adjust the top edge of the beam to ensure alignment of the beams and installation of a level surface.

DETAILED DESCRIPTION

Figure 1:
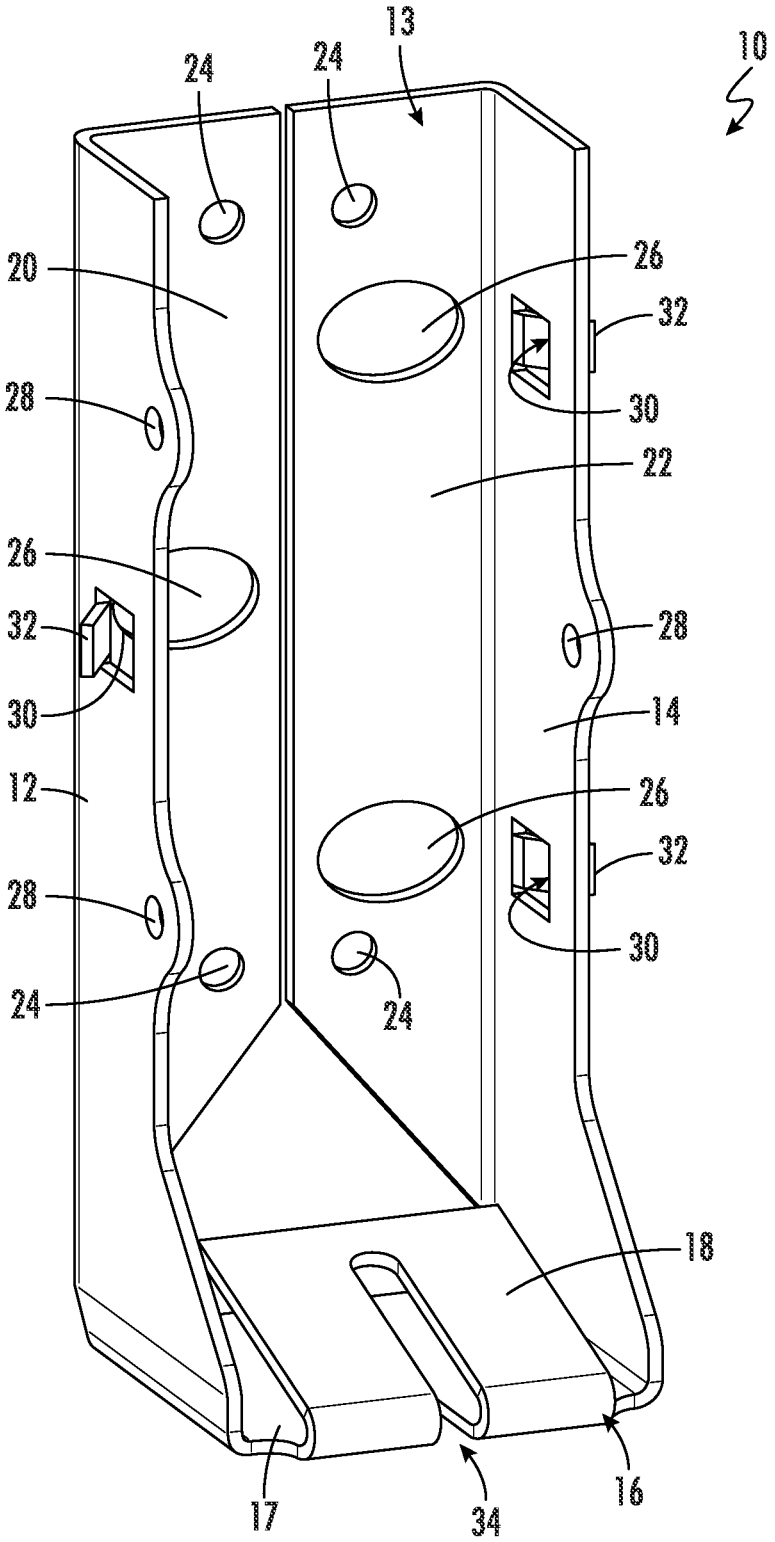
FIG. 1 shows an embodiment of a height-adjustable hanger.
Figure 2:
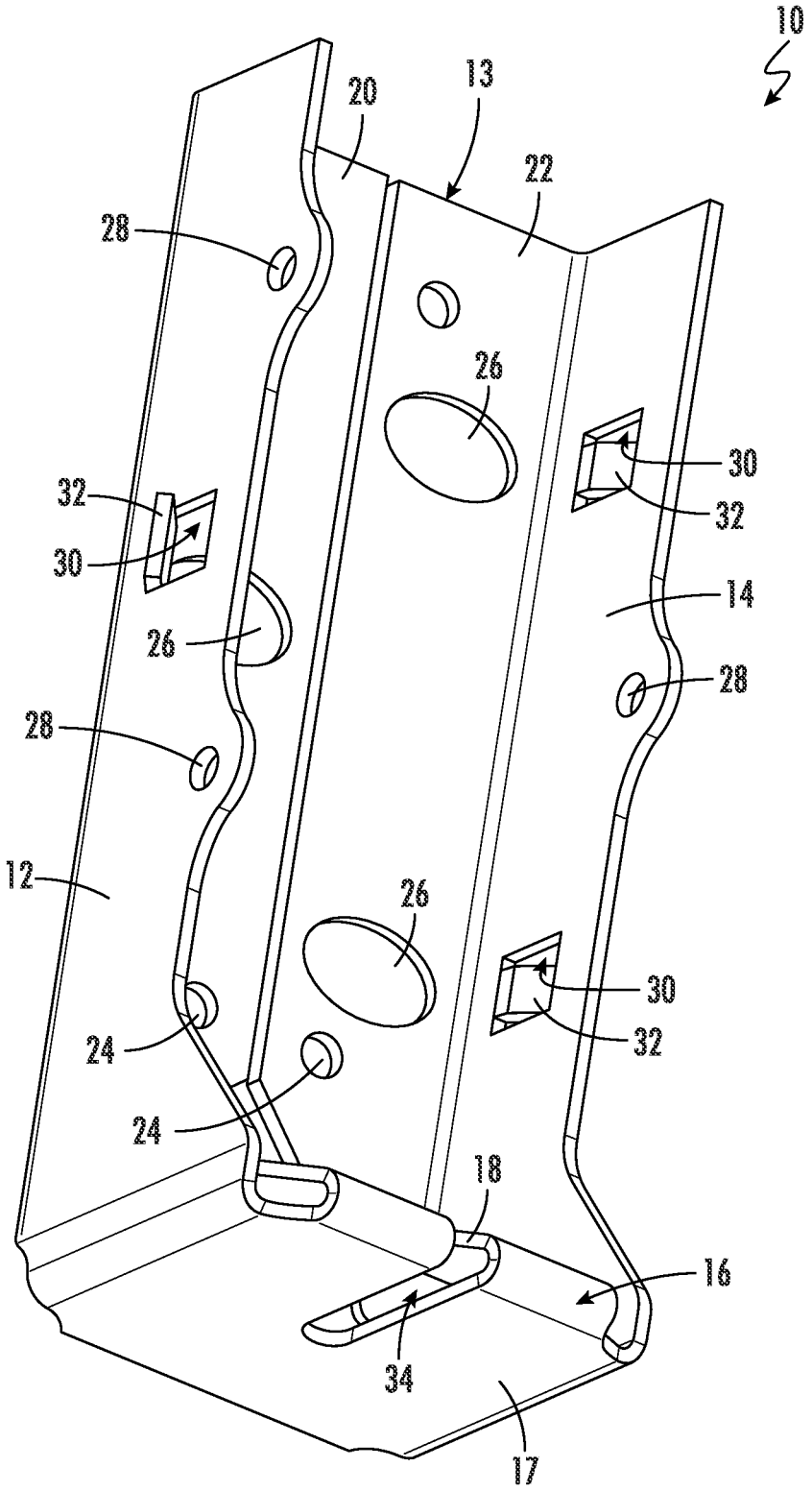
FIG. 2 is another view of the hanger of FIG. 1.
Figure 3:
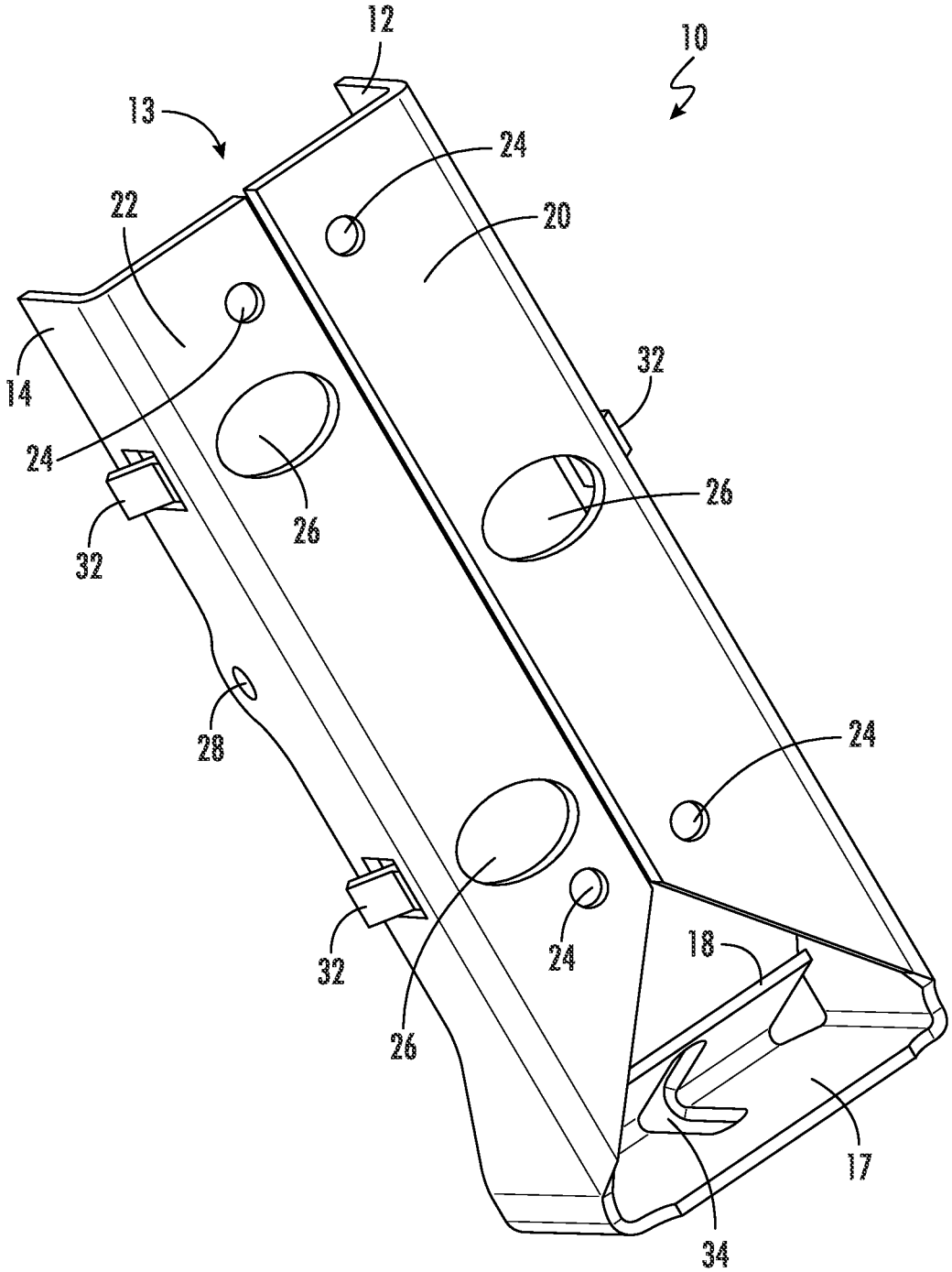
FIG. 3 is a rear perspective view of the hanger of FIG. 1.
Figure 4:
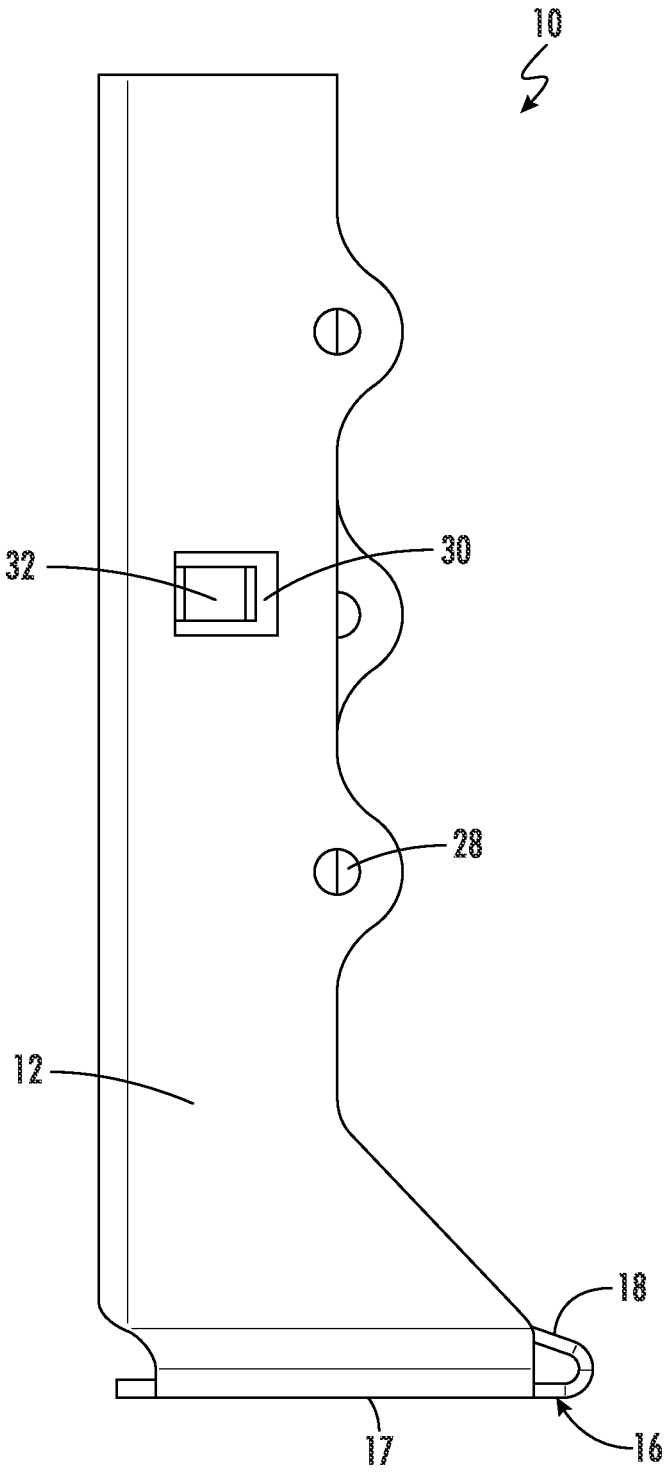
FIG. 4 is a side elevation view of the hanger of FIG. 1.

Among the benefits and improvements disclosed herein, other objects and advantages of the disclosed embodiments will become apparent from the following wherein like numerals represent like parts throughout the several figures. Detailed embodiments of a height adjustable hanger are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a joist hanger for attaching a joist beam to a rear ledger. However, it is understood that the embodiments are not limited as such, and the inventive concepts embodied in the disclosed embodiments apply to a wide variety of hangers or brackets for use in attaching elongate building support members or beams to another support member. Herein, the term "joist" is synonymous with and shall encompass a beam or elongate building member. Likewise, the term "ledger" is synonymous with and shall encompass any building support member or structure to which a beam may be attached.

With reference to the drawings wherein like numerals represent like parts throughout the figures, an adjustable hanger 10 is shown and described. As shown, the hanger 10 includes a flat first side panel 12 and flat second side panel 14 that are parallel to one another and define the lateral extent of a joist receiving cavity 13. A web 16 extends laterally between the first side 12 and second side 14. The web 16 includes a flat bottom panel 17 and a compression member 18 that provides an upward bias on a joist retained within the cavity 13. The bottom panel is preferably substantially perpendicular to the sides 12 and 14 and to the rear flanges 20 and 22 (described below). In a preferred embodiment, the compression member 18 takes the form of a leaf spring formed via an oblique bend at the front edge of the bottom panel. The web 16 defines an intermediate slot 34 through the bottom panel 17 and compression member 18, which can be used to further assist adjustment of the vertical position of the joist during installation, as will be described in greater detail below. In other embodiments, the compression member 18 has the same form, but will not "spring" upward once compressed; rather it will permanently deform in a compressed state, as will be discussed in detail below. Additionally, several other embodiments exist having a compression member of a different configuration.

A rear flange, 20 and 22, extends inwardly from each side at the respective rear edge. The flanges define a plurality of primary holes 24 and one or more secondary holes 26 that are larger than the primary holes. Additionally, each side, 12 and 14, defines one or more side holes 28 and one or more toenail holes 30. In the depicted embodiments, each of the toenail holes 30 is formed as a cutout in the respective side with an outward bend yielding a toenail flange 32. Notably, each toenail hole 30 is aligned vertically with a secondary hole 26 in one of the rear flanges such that a fastener driven obliquely through the toenail hole can pass through the aligned secondary hole 26. Preferably, holes of the same type (primary 24, secondary 26, side 28 and toenail 30) are staggered vertically relative to other holes of the same type, which assists a robust connection between all elements and structural integrity when installed.

Figure 6:
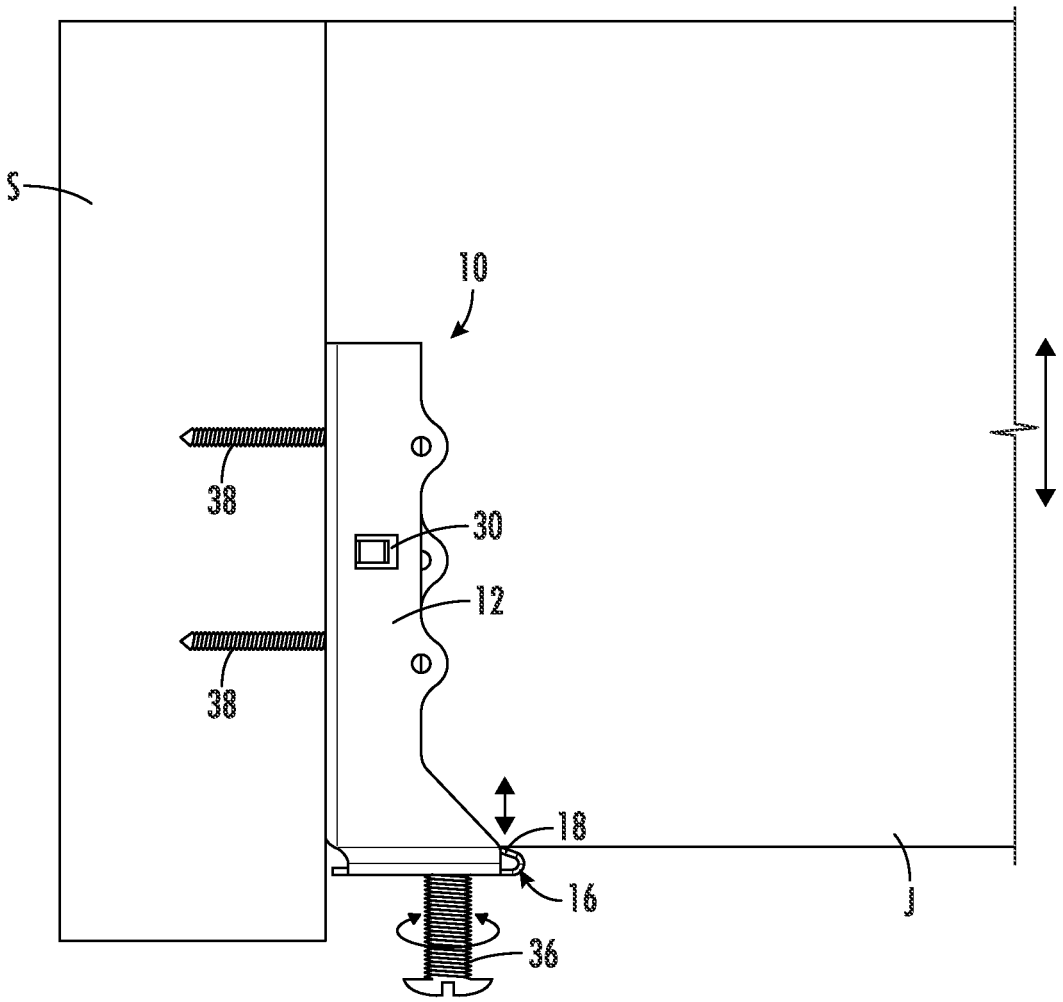
FIG. 6 shows a side view of the hanger of FIG. 1 installed holding a beam to a ledger.

With reference to FIG. 6, in a typical installation, the hanger 10 is first attached to a building support member S, such as a ledger, via fasteners 38 driven through the primary holes 24 in the back flanges, 20 and 22, at a predetermined preferred height. A beam, such as a joist, J is then placed within the cavity 13 with its rear edge against the flanges, 20 and 22, and resting on the compression member 18. An installer can then finely adjust the exact height of the top edge of the joist J, usually downward against the upward bias from the compression member 18, but in some cases upward with assistance of the biasing force of the compression member 18.

In the depicted preferred embodiment, vertical adjustment may be performed with additional assistance of a screw or bolt 36 from underneath the joist J and hanger 10. In this case, the shank of the screw 36 is inserted through the web 16 via the intermediate slot 34 and penetrates the wooden joist J. Once the screw 36 is driven enough that the head of the screw 36 abuts the flat bottom panel 17, further rotation in the screw driving direction acts to pull the wooden joist J downward against the bias of the compression member 18. In this manner, the flat bottom panel 17 provides a leveraging surface for the head of the fastener. On the other hand, in some embodiments, if the joist J needs to be adjusted upward, reverse rotation of the screw 36 unscrews from the wood, thereby releasing tension in the compression member 18 and allowing the joist J to move upward with the force of the compression member. In other embodiments, the compression member 18 permanently deforms in a compressed state and will not "spring" back to allow later upward adjustment. FIG. 6 shows a representation of this optional screw-assisted height adjustment. Once the top edge of the joist J is set to the preferred height via the described fine adjustment process and mechanism, the joist J can be fixed at the height via driving nails or other fasteners laterally through side holes 28 into the joist.

A typical installation is finally reinforced via forming a strong "toenail" connection with additional fasteners driven obliquely through the toenail holes 30, through a rear portion of the joist J, through the secondary holes 26 in the rear flanges and into the support member S. When the fasteners are installed to form the toenail connection, each fastener head is supported by a toenail flange 32, forming a rigid and robust connection.

Figure 5:
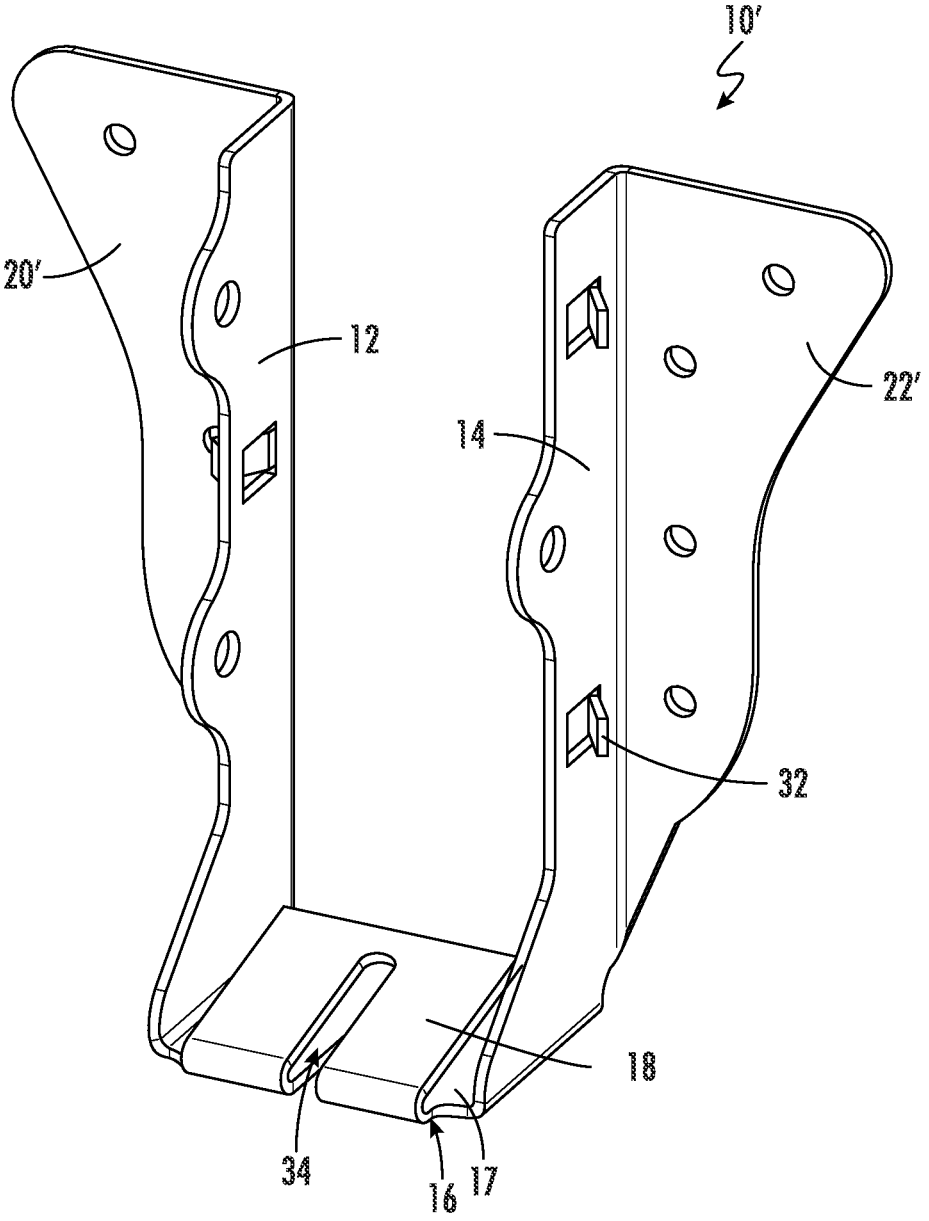
FIG. 5 shows another embodiment of a height-adjustable hanger with outward facing rear flanges.

The hanger 10 is preferably formed of metal, such as a steel sheet. The properties (i.e., thickness, dimensions) of the steel can be adjusted as desired to affect a desired spring constant in the compression member and resulting upward bias force and force required to pull the beam downward against the compression member. Additionally, other reasonable alterations to the specific elements and relationships may be made, such as changes in element sizes, shapes, position of flanges, number of different holes, etc. For example, FIG. 5 shows an alternate embodiment of the joist hanger 10' with outwardly bent rear flanges 20' and 22' in place of the inward (hidden) flanges 20 and 22 of the hanger 10. Additionally, in some embodiments, the slot 34 through the web 16 is replaced with aligned holes through the bottom panel 17 and compression member 18.

In some embodiments, the side holes 28 include an offset raised surface 40 circumscribing the hole. The offset raised surface 40 is configured to assist alignment of a driving tool by providing an abutment surface for the nose of the tool. Additionally, the offset raised surfaces 40 act to retain integrity of the side panels, 12 and 14, after driving of a fastener. The single sheet panels can otherwise occasionally deform under the pressure of the fastener head.

Figure 7:
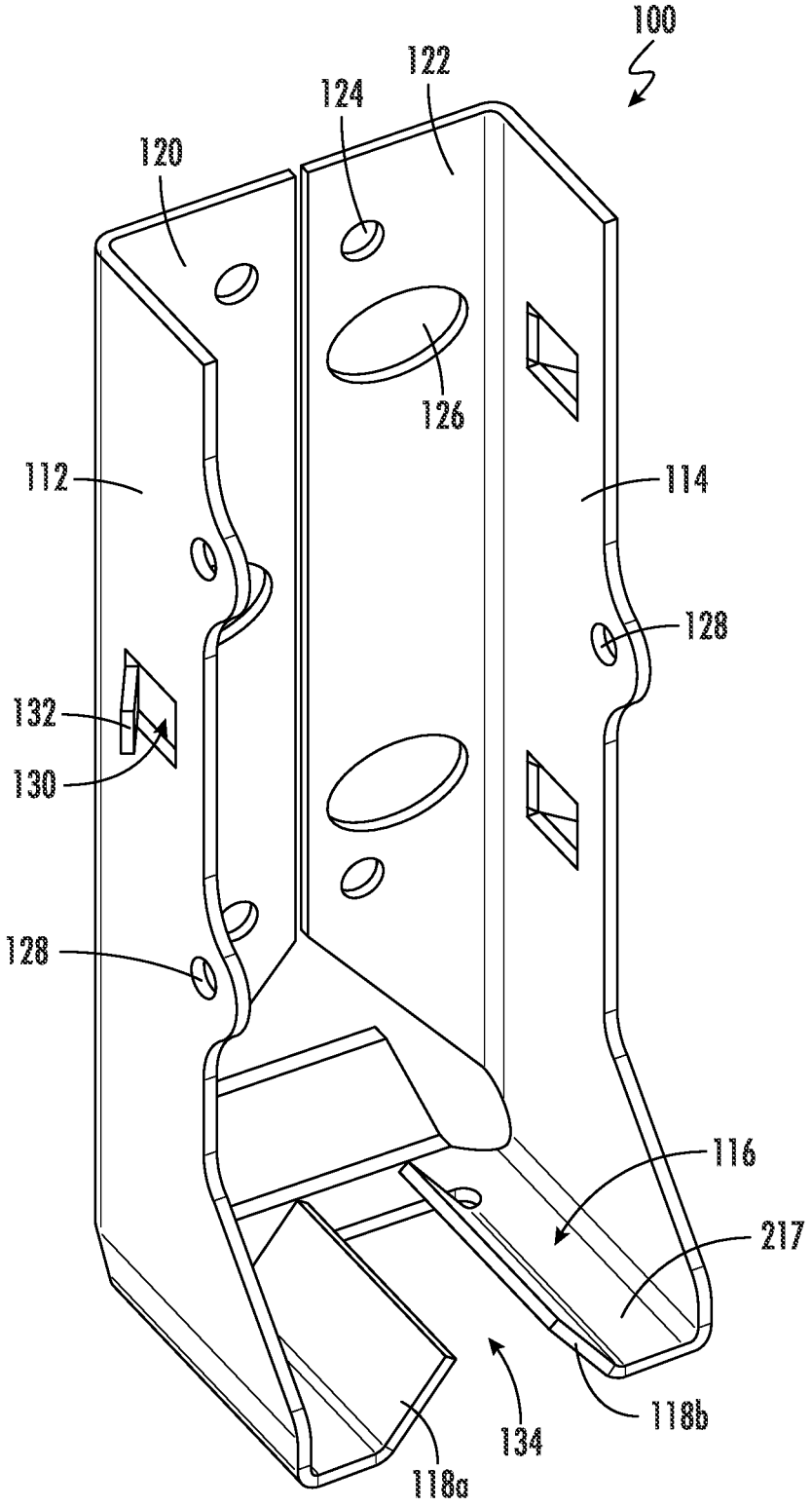
FIG. 7 is a perspective view of another embodiment of the height-adjustable hanger.
Figure 8:
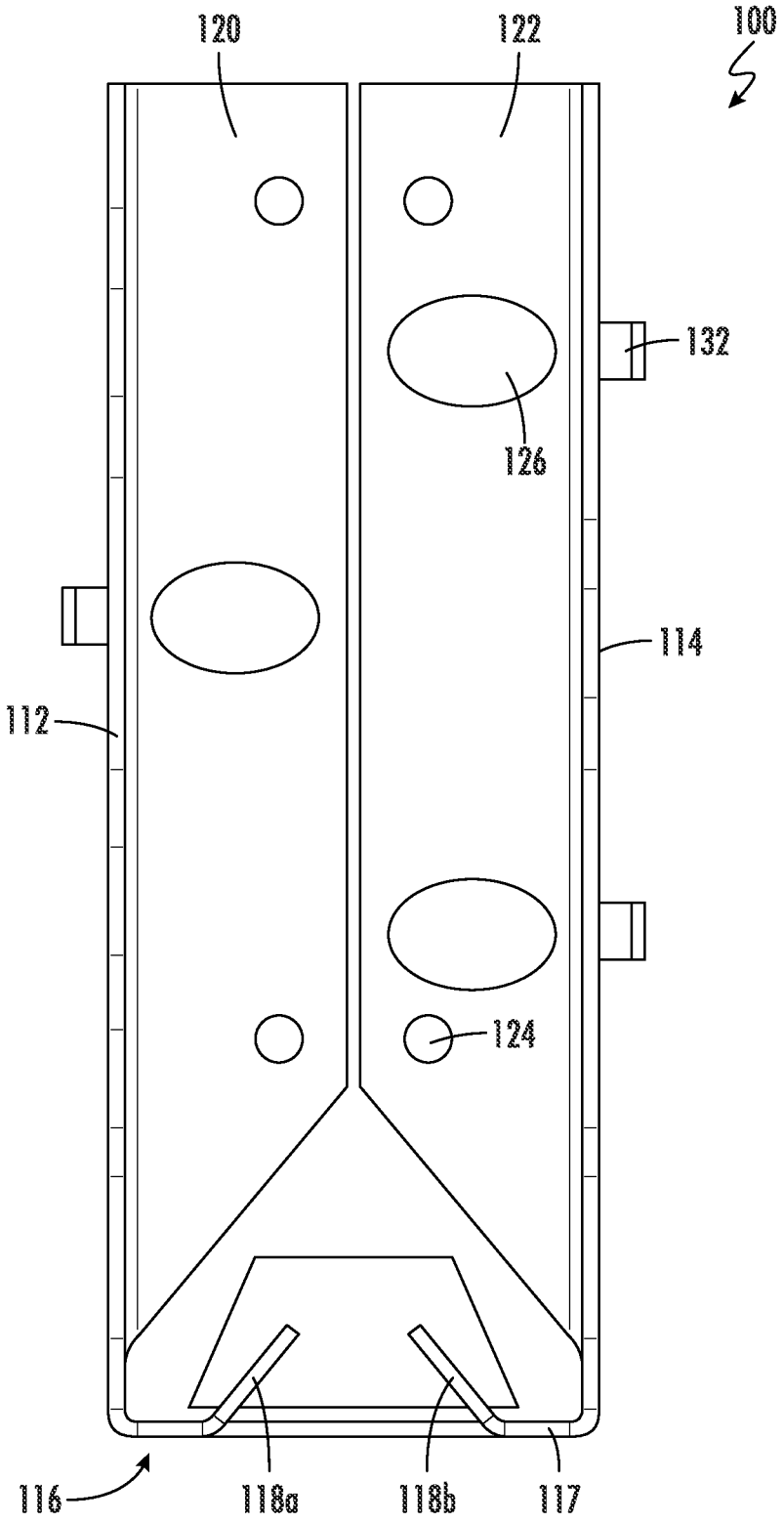
FIG. 8 is a front elevation view of the hanger of FIG. 7.

Another embodiment of the disclosed hanger 100 is depicted in FIGS. 7-8. This embodiment has many commonalities with the earlier embodiment of the hanger 10, including, for example a pair of side panels, 112 and 114, laterally spaced from one another and a lower support web 116. In this embodiment, the web 116 comprises a flat bottom panel 117 extending integrally from a bottom edge in a rear panel 123, and a compression member is formed from two opposing portions, 118*a* and 118*b*. As can be seen with reference to FIGS. 7 and 8, the first compression member portion 118*a* extends integrally from a bend at the bottom edge of the first side panel 112 and the second compression member portion 118*b* extends integrally from a bend at the bottom edge of the second side panel 114. The flat bottom panel defines a screw hole 133 that is laterally aligned with the slot 134 defined between the compression member portions, 118*a* and 118*b*. Like the earlier embodiment of the hanger 10, the depicted hanger 100 includes rear flanges, 120 and 122, and a plurality of primary holes 124, secondary holes 126, side holes 128 and toenail holes 130 with toenail flanges 132, to assist in attaching the hanger 100 to a building support member S.

The hanger 100 operates much the same as the hanger 10. An installer typically first attaches the hanger 100 to the building support at a preferred approximate height via fasteners driven through holes in the rear flanges, 120 and 122. The beam (joist), like that depicted generally as reference letter J in FIG. 6 is thereafter placed within the cavity defined between the side panels, 112 and 114, and web 116, and is supported by the compression member portions, 118*a* and 118*b*. The installer may then finely adjust the height of the beam by inserting a screw through the hole 133 in the web and the slot 134 and rotatably drive it into the wooden beam. Driving of the fastener acts to pull the beam J downward against the upward bias force of the compression member portions as the compression member portions bend or compress downward.

Figure 9:
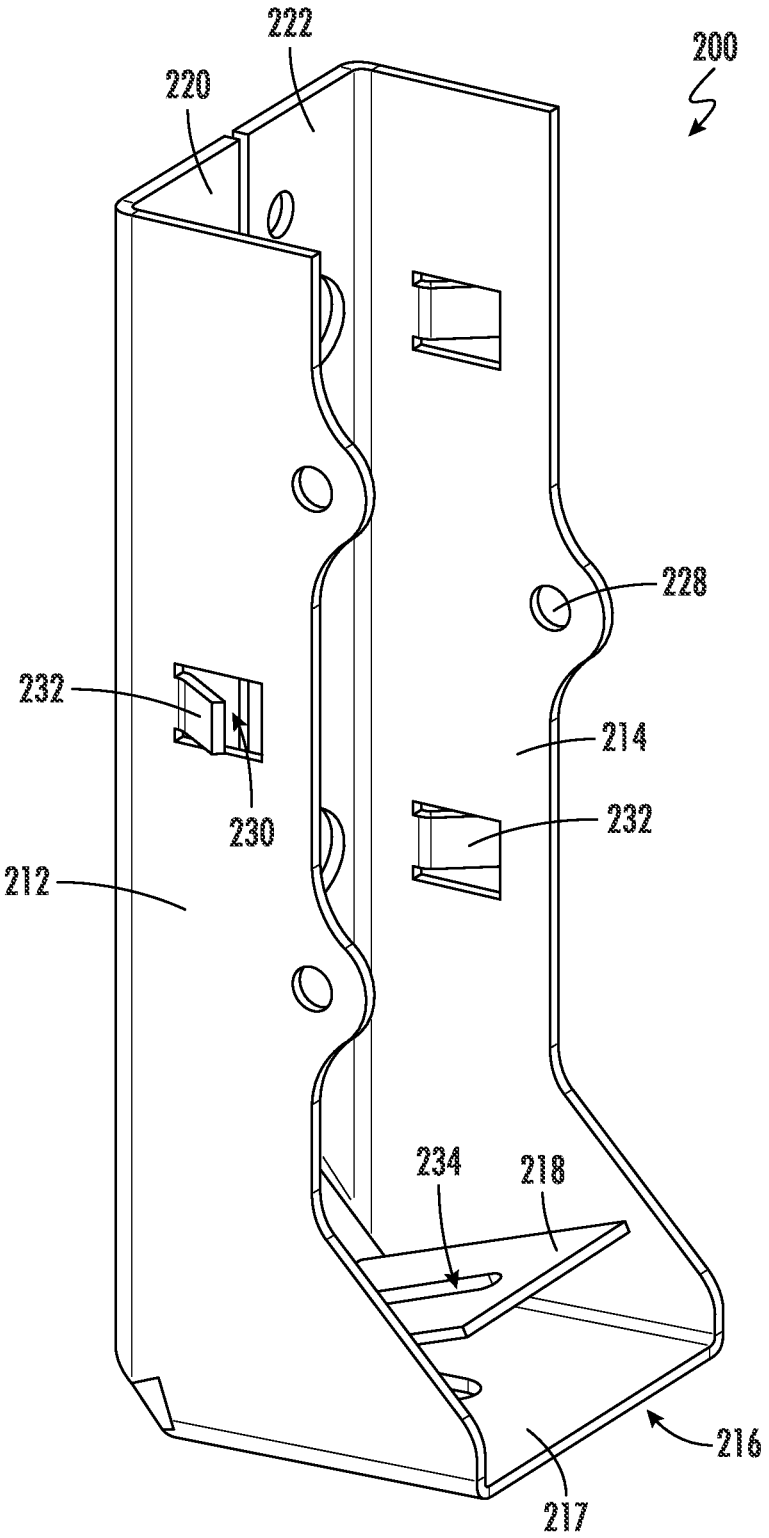
FIG. 9 is a perspective view of yet another embodiment of the height-adjustable hanger.
Figure 10:
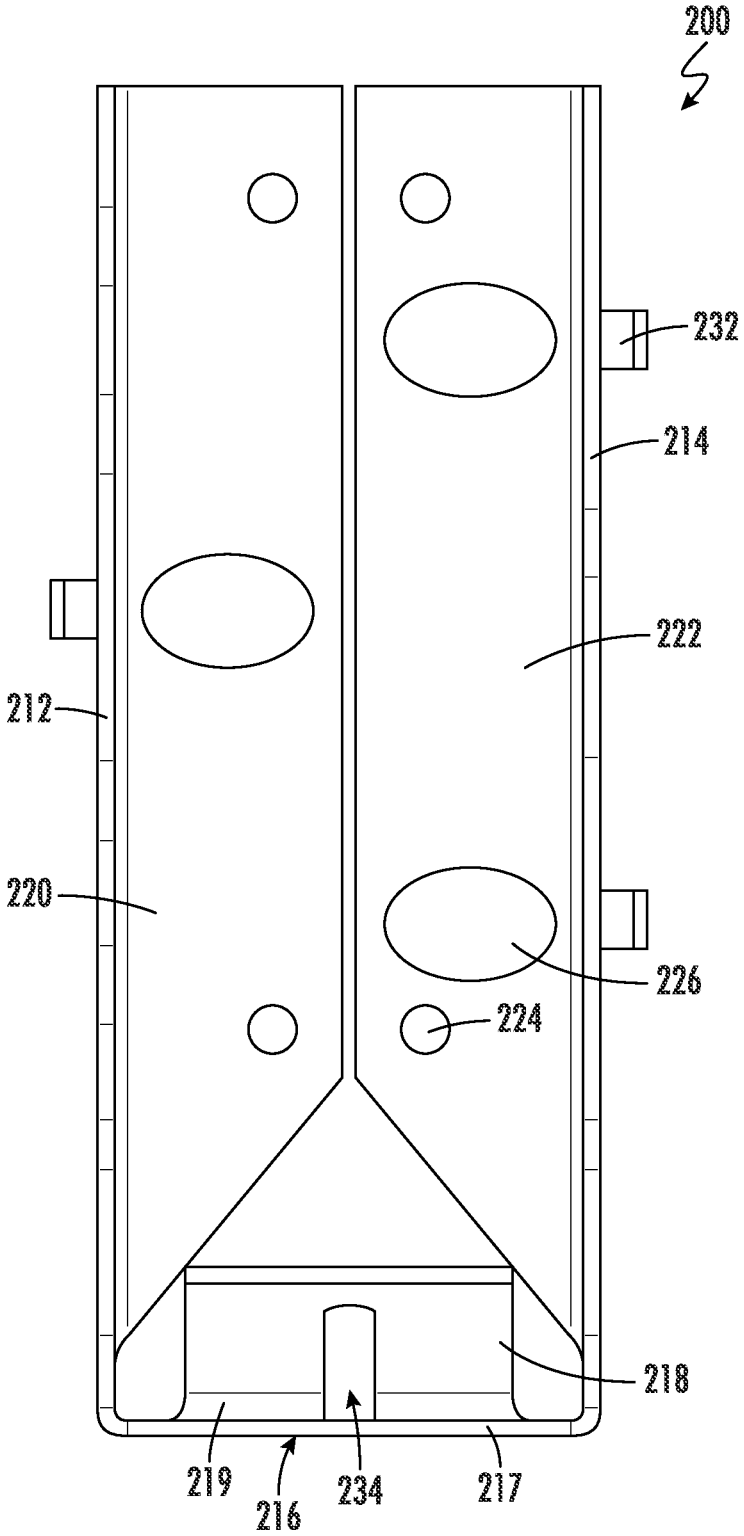
FIG. 10 is a front elevation view of the hanger of FIG. 9.

Yet another exemplary embodiment of the hanger 200 is depicted in FIGS. 9 and 10. Like the earlier embodiments, the hanger 200 comprises a first side panel 212 spaced laterally from a second side panel 214 and a web 216 generally formed by a bottom panel 217 and compression member 218. Like the hanger 10, in this embodiment, the bottom panel 217 extends integrally between the first panel and second panel, 212 and 214, and can be said to establish a spacing therebetween. The compression member 218 extends obliquely upward as a bend 219 from the bottom panel 217. The compression member 218 also includes a slot 234 or a hole aligned with a slot or hole 233 in the bottom panel 217 through which a screw can extend. Here, as in the earlier embodiment, one integral slot extends through both the compression member 218 and flat bottom panel 217. Also like the earlier embodiments of the hanger, the depicted hanger 200 includes rear flanges, 220 and 222, and a plurality of primary holes 224, secondary holes 226, side holes 228 and toenail holes 230 with toenail flanges 232.

The hanger 200 is installed and used just like the hanger 10. First, the hanger 200 is attached to a support member S with fasteners driven through primary holes 224. An elongate beam, like a joist J, is installed between the side panels, 212 and 214, resting on the compression member 218. The height of the joist can be finely adjusted via a threaded fastener inserted upward through the web slot 234, and threading the fastener into the wooden beam to pull the beam downward against the bias of the compression member.

Alternatively, the compression member 218 extends inward from a rear panel instead of from the bottom panel 217.

Further, in some embodiments, the bottom panel is replaced by a support member that is not completely flat or does not take a rectangular shape, such as a different shape of bent metal to form an abutment surface for the head of a screw as the screw is driven into the beam to pull the beam downward against the compression member. Each of the disclosed embodiments provides a hanger for a beam (or joist) that allows fine adjustment of the height of the supported beam by providing a leveraging surface against a screw/fastener head whereby continued screwing into the beam pulls the beam downward against an upward bias.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A hanger for supporting an elongate beam, comprising:
a first side extending from a top to a bottom;
a second side extending from a top to a bottom and spaced laterally from the first side;
a web extending between and connected to the first side and the second side proximate the respective bottoms, wherein
the web comprises an integral compression member configured for providing a bias force in a direction toward the tops of the first and second sides.

2. The hanger of claim 1, wherein the compression member is a metal sheet panel formed integrally to the web via a bend in the metal sheet material.

3. The hanger of claim 2, comprising a slot in the metal sheet panel at a position intermediate the first side and second side.

4. The hanger of claim 3, wherein the slot extends through a front end of the web and compression member.

5. The hanger of claim 1, wherein the compression member is an obliquely extending panel integral to the web formed as a bend at a front end.

6. The hanger of claim 1, comprising a first rear flange extending perpendicular from the first side and a second rear flange extending perpendicular from the second side, each rear flange defining one or more primary holes for a fastener to pass through and one or more secondary holes having a different size from the primary holes.

7. The hanger of claim 6, wherein each side defines at least one toenail hole that is vertically aligned with a respective secondary hole, wherein an elongate fastener can be driven obliquely through a toenail hole and associated secondary hole and into a rear building support member.

8. The hanger of claim 7, wherein
each of the toenail holes is formed as a cutout from the first side or the second side with an outward bend forming a side support flange, and
wherein the head of a fastener driven obliquely through a toenail hole abuts the support flange.

9. The hanger of claim 1, wherein the web includes a flat lower portion substantially perpendicular to the first side and second side and the compression member is formed as an upward bend from a front edge of the flat lower portion.

10. The hanger of claim 9, wherein the flat lower portion and the compression member each defines an opening at a laterally intermediate position between the first side and the second side.

11. The hanger of claim 1, wherein A hanger for supporting an elongate beam, comprising:
a first side extending from a top to a bottom;
a second side extending from a top to a bottom and spaced laterally from the first side;
a web extending between and connected to the first side and the second side proximate the respective bottoms, wherein
the web comprises a compression member configured for providing a bias force in a direction toward the tops of the first and second sides, and
the web comprises a bottom panel with the compression member positioned above a bottom panel, further comprising an opening in the bottom panel substantially laterally aligned with an opening in the compression member such that a fastener can be positioned with a shank thereof extending through openings and in contact with a beam received by the hanger laterally between the first side and second side.

12. The hanger of claim 11, wherein the opening in bottom panel and the opening in the compression member are integral portions of a slot.

13. The hanger of claim 11, wherein the compression member is integral with the bottom panel.

14. The hanger of claim 13, wherein the compression member is formed as a bend from an edge of the bottom panel.

15. The hanger of claim 11, wherein the bottom panel is substantially perpendicular to the first side and the second side.

16. The hanger of claim 11, wherein bottom panel comprises a leveraging surface for a head of a fastener driven through the slot.

17. A hanger for supporting an elongate beam, comprising:
a first side extending from a top to a bottom;
a second side extending from a top to a bottom and spaced laterally from the first side;
a web extending between and connected to the first side and the second side proximate the respective bottoms, wherein
the web comprises a lower portion and a compression member configured for providing a bias force in a direction toward the tops of the first and second sides, and
a slot extends rearwardly from a front edge through a portion of the lower portion and a portion of the compression member, the slot positioned laterally intermediate position between the first side and the second side.

18. A building support connection, comprising:
a building support member;
a hanger comprising a first side extending longitudinally from a top to a bottom and a second side spaced laterally from the first side and extending longitudinally from a top to a bottom, a web with an integral compression member extending between the first side and second side proximate the respective bottoms; and
an elongate beam received by the hanger laterally between the first side and second side and extending outward from the building support member, wherein
the hanger is fixed to the building support with the web, first side and second side extending outward with the beam supported longitudinally by the web, and
when the beam is received between the first side and second side, the beam is supported by the web with the compression member biasing the beam member toward the top ends.

19. The building support connection of claim 18, wherein the web further comprises a leveraging surface below the compression member, comprising at least one opening providing a passthrough from underneath the leveraging surface to the beam.

20. The building support connection of claim 19, comprising a threaded fastener with a head positioned beneath the leveraging surface and a shank extending through the at least one opening in contact with the beam.

21. The building support connection of claim 18, wherein the web further comprises a leveraging surface below the compression member and the compression member is an obliquely extending panel formed as an upward bend from the leveraging surface.

22. The building support connection of claim 21, wherein the bend is formed in a front edge of the leveraging surface and the beam extends forward of the front edge.

23. The building support connection of claim 21, wherein the leveraging surface is a surface of a flat bottom panel.

24. The building support connection of claim 21, wherein the hanger comprises an opening extending through a portion of the web and compression member, wherein a fastener can be driven through the opening and into a lower edge of the beam and further driving of the fastener pulls the beam downward against the upward bias of the bias member.

25. The hanger of claim 1, wherein the web defines a leveraging surface and the web, first side and second side define a beam receipt channel therebetween, further comprising one or more passthrough apertures connecting from underneath the leveraging surface, through the compression member, and into the channel, wherein when a beam is received within the channel in abutment with the compression member in a first longitudinal position, the one or more passthrough apertures allows a shank to be inserted from underneath the leveraging surface through the one or more passthrough openings into contact with the beam to adjust the beam to a second position different from the first longitudinal position.

* * * * *